United States Patent [19]

Selby

[11] Patent Number: 4,882,954

[45] Date of Patent: Nov. 28, 1989

[54] UNLOCKING DEVICE FOR VEHICLE DOORS

[76] Inventor: Douglas S. Selby, Rte. 5, Red Hill Dr., Unit R-2, Louisville, Tenn. 37777

[21] Appl. No.: 171,395

[22] Filed: Mar. 21, 1988

[51] Int. Cl.[4] ..... E05G 19/20

[52] U.S. Cl. ..... 81/15.9

[58] Field of Search ..... 81/15.9; 70/465; 29/278, 267; 254/131

[56] References Cited

U.S. PATENT DOCUMENTS

| | | | |
|---|---|---|---|
| 2,027,009 | 1/1936 | Wyscaver | 81/15.9 |
| 3,664,211 | 5/1972 | McConnell | 81/15.9 |
| 4,608,866 | 9/1986 | Bolton | 81/15.9 |
| 4,655,102 | 4/1987 | Parkins | 81/15.9 |
| 4,683,783 | 8/1987 | Fanberg | 81/15.9 |

*Primary Examiner*—Roscoe V. Parker

*Attorney, Agent, or Firm*—Pitts and Brittian

[57] ABSTRACT

An unlocking device (10) for unlocking a vehicle door in the absence of a key. The unlocking device (10) comprises an elongated shank (12) having a first end portion (14) and a second end portion (16). The first end portion (14) of the shank (12) carries a first linkage engaging means (18) and the second end portion (16) of the shank (12) carries a second linkage engaging means (20). The first and further linkage engaging means each defines an arm (22) having an outboard end provided with a U-shaped engaging member (24) for selectively engaging and actuating the door lock linkage (28) of the vehicle door.

11 Claims, 9 Drawing Sheets

Fig. 5A(1)

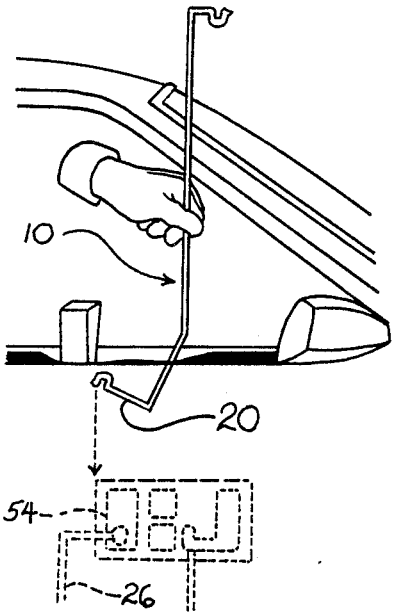
Fig. 9A
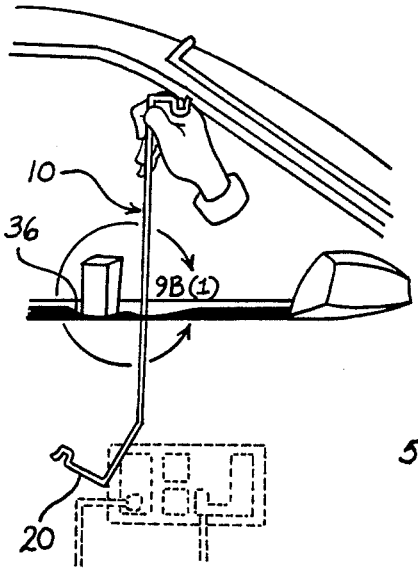
Fig. 9B
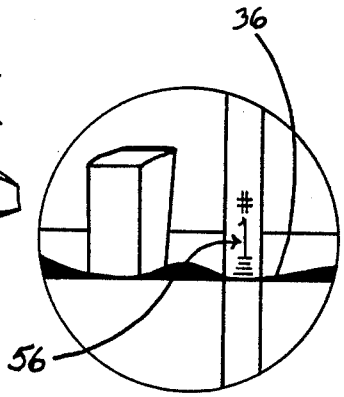
Fig. 9B(1)
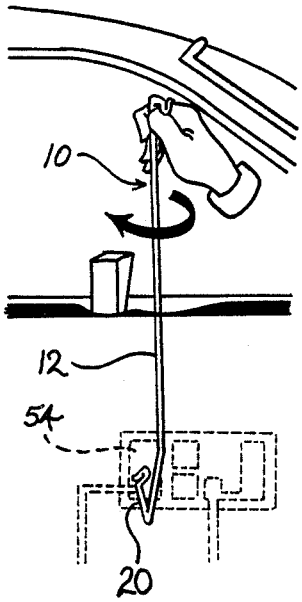
Fig. 9C
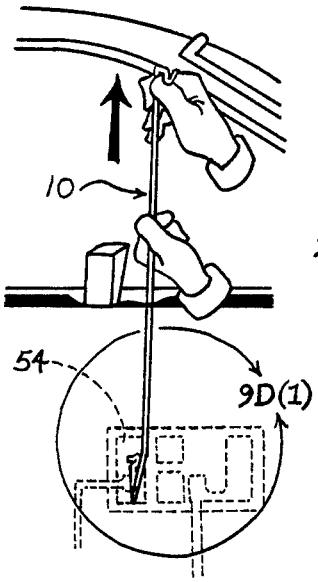
Fig. 9D
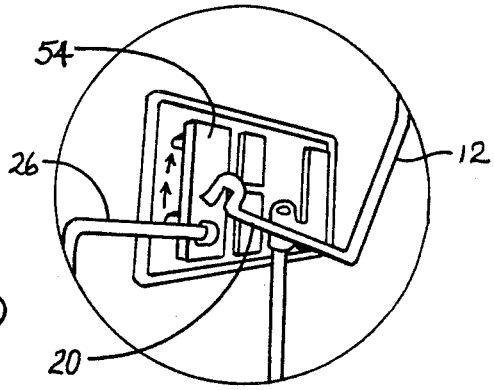
Fig. 9D(1)

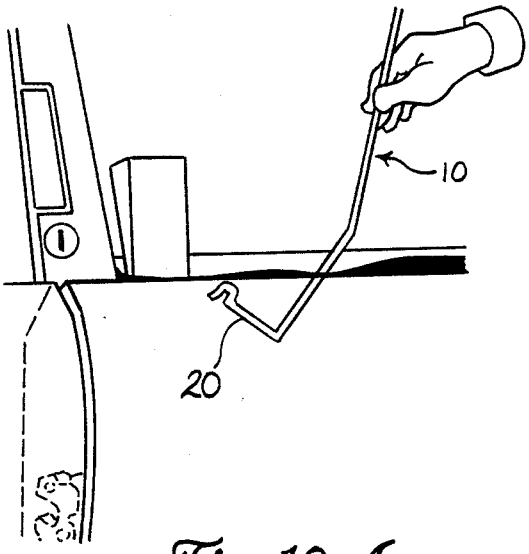
Fig. 10A
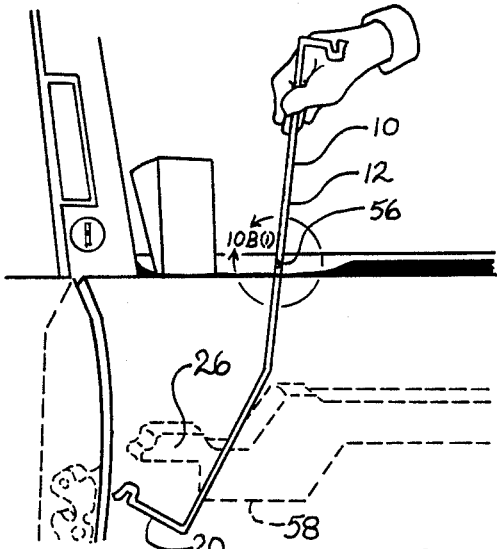
Fig. 10B
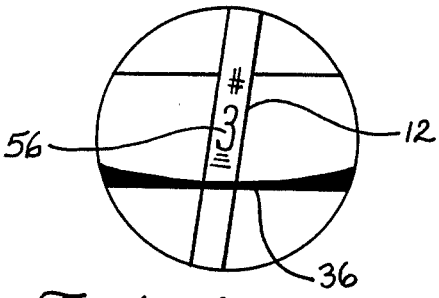
Fig. 10B(1)
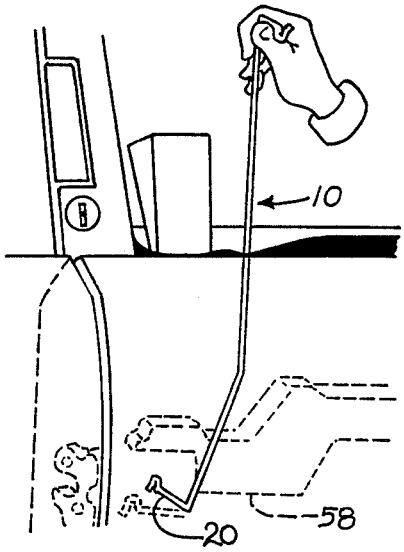
Fig. 10C
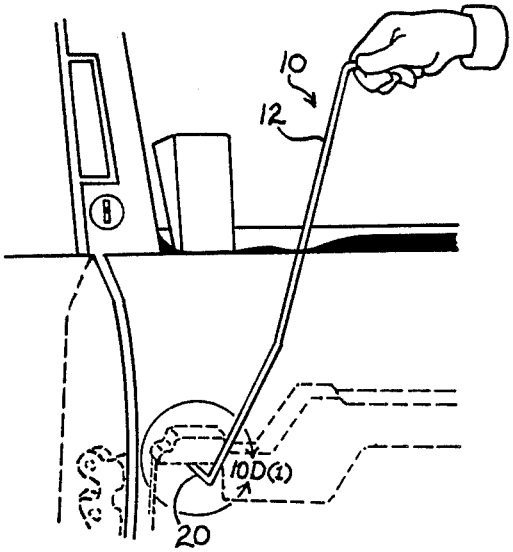
Fig. 10D
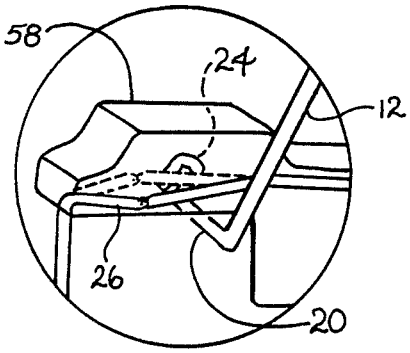
Fig. 10D(1)

UNLOCKING DEVICE FOR VEHICLE DOORS

TECHNICAL FIELD

This invention relates to an unlocking device for unlocking a vehicle door in the absence of a key. In this particular invention, the device comprises an elongated shank provided with linkage engaging means at its opposite end portions.

BACKGROUND ART

Various devices are known in the art for assisting locksmiths and car dealers in unlocking automobile and truck doors when a door key is unavailable. In this regard, conventional locking mechanisms of vehicle doors generally comprise a door lock linkage housed within the door which extends from a manual locking mechanism actuated by a button or switch to a key actuated lock cylinder. Keyless door unlocking devices are generally designed to engage and selectively actuate the door lock linkage to effect the unlocking of the door. However, the location and orientation of the linkage differs among vehicles and heretofore different unlocking devices have been necessary for different locking mechanisms. For example, a notched metal strip commonly known as a "Slim Jim" is designed for vehicles having vertically oriented door lock linkages, but is ineffective in opening doors having slide locks with horizontal linkages. Further, devices such as the unlocking device of letters U.S. Pat. No. 4,608,866, with its flexible member and various similar devices on the market are effective for unlocking doors of medium thickness and having unguarded horizontally oriented lock linkages, but are not effective in opening doors with vertical linkages. Moreover, most prior art devices are frustrated by anti-theft guards and other such devices which have been added to vehicles in recent years.

Therefore, it is an object of the present invention to provide an unlocking device for unlocking vehicle doors without a key.

It is a further object of the present invention to provide an unlocking device for unlocking vehicle doors which will unlock the doors of a wide variety of vehicles, including vehicles with vertically oriented linkages and horizontally oriented linkages.

Yet another object of the present invention is to provide an unlocking device which is effective for unlocking vehicle doors provided with anti-theft guards, including window guards, linkage guards, shields provided on various locking systems, etc.

Another object of the present invention is to provide an unlocking device which is inexpensive to manufacture, and which obviate the need for purchasing a wide variety of tools to unlock vehicle doors having differing thicknesses and differing locking mechanisms.

DISCLOSURE OF THE INVENTION

Other objects and advantages will be accomplished by the present invention which provides an unlocking device for unlocking a vehicle door in the absence of a key. The unlocking device comprises a elongated shank having a first end portion and a second end portion. The first end portion of the shank carries a first linkage engaging means for selectively engaging and actuating the door lock linkage of a vehicle door to effect the unlocking of the door. The first engaging means includes an arm defining a first length and having an outboard end provided with a U-shaped engaging member for releasably engaging the door lock linkage. A further linkage engaging means is provided at the second end portion of the shank, the further linkage engaging means including an arm defining a greater length than the arm of the first engaging means. The arm of the further engaging means also defines an outboard end provided with a U-shaped engaging member for selectively engaging the door lock linkage.

BRIEF DESCRIPTION OF THE DRAWINGS

The above-mentioned features of the present invention will become more clearly understood from the following detailed description of the invention read to with the drawings in which:

FIGS. 9A through 9D(1) are diagrammatic perspective views of an unlocking device of the present invention being utilized to unlock a vehicle door;

FIGS. 10A through 10D(1) are diagrammatic perspective views of an unlocking device of the present invention being utilized to unlock a vehicle door.

BEST MODE FOR CARRYING OUT THE INVENTION

An unlocking device incorporating various features of the present invention is illustrated generally at 10 in the figures. The device 10 is designed for engaging the door lock linkage of an automobile, truck, or other vehicle, and unlocking the door without the benefit of a key. Moreover, the device 10 is designed to unlock vehicle doors of various thicknesses and doors having vertical door lock linkages, and doors having horizontal door lock linkages, whether or not the doors are provided with various conventional anti-theft devices.

Figure 1:
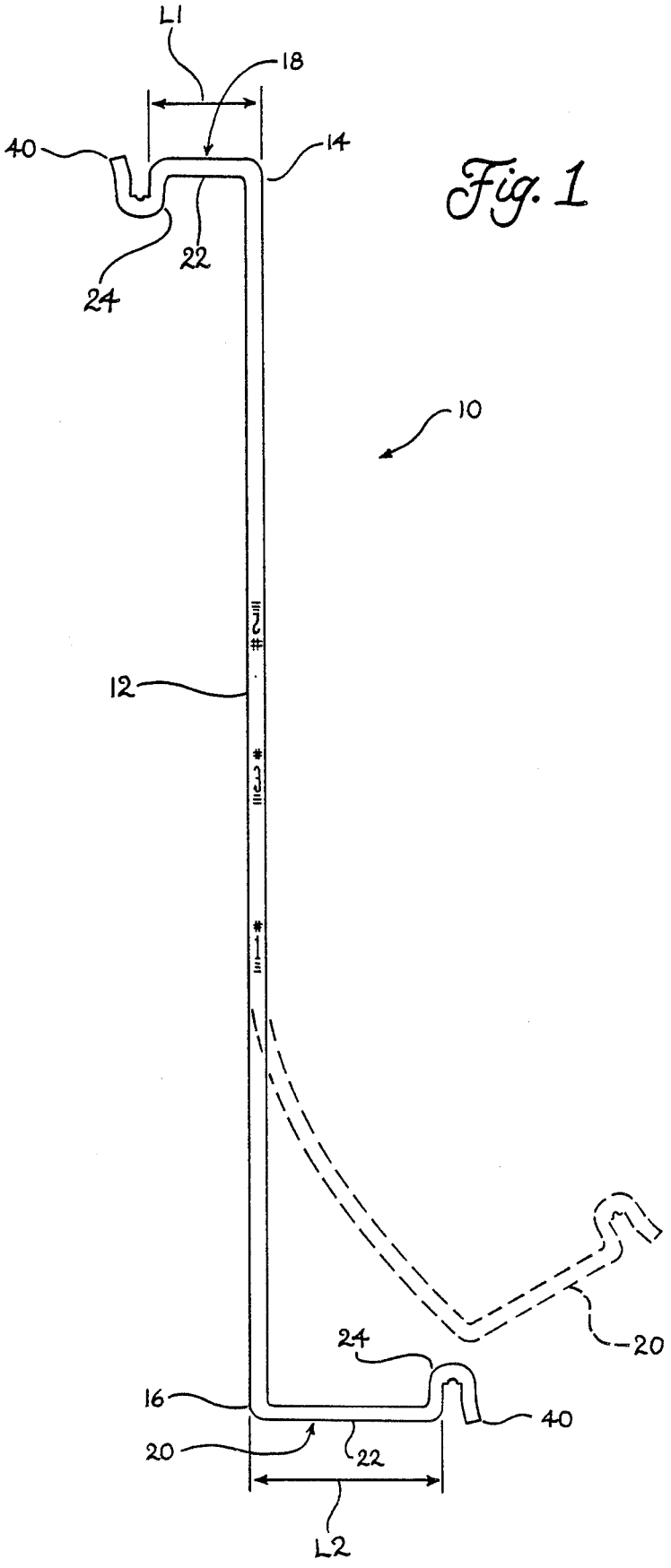
FIG. 1 is a side elevation view of an unlocking device of the present invention.
Figure 2:
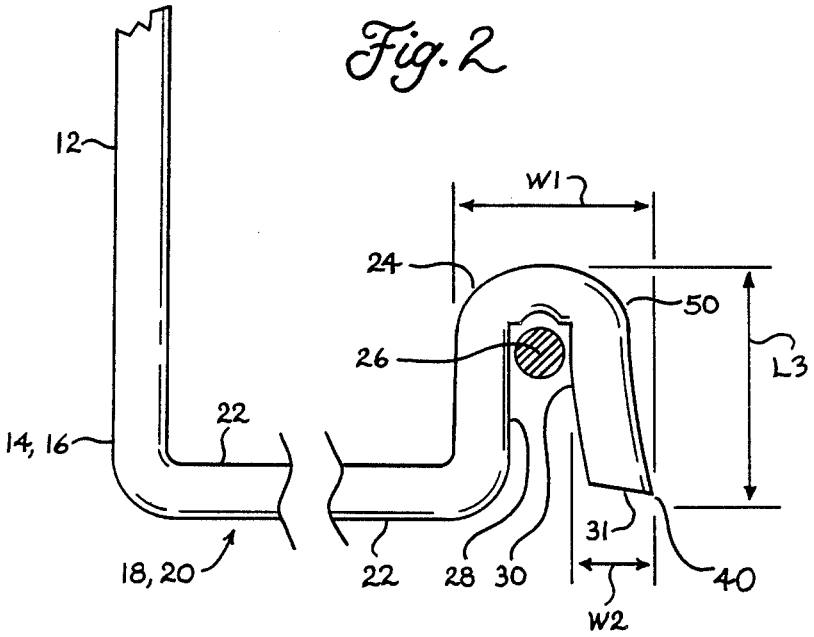
FIG. 2 is a partial side elevation of an unlocking device of the present invention.
Figure 3:
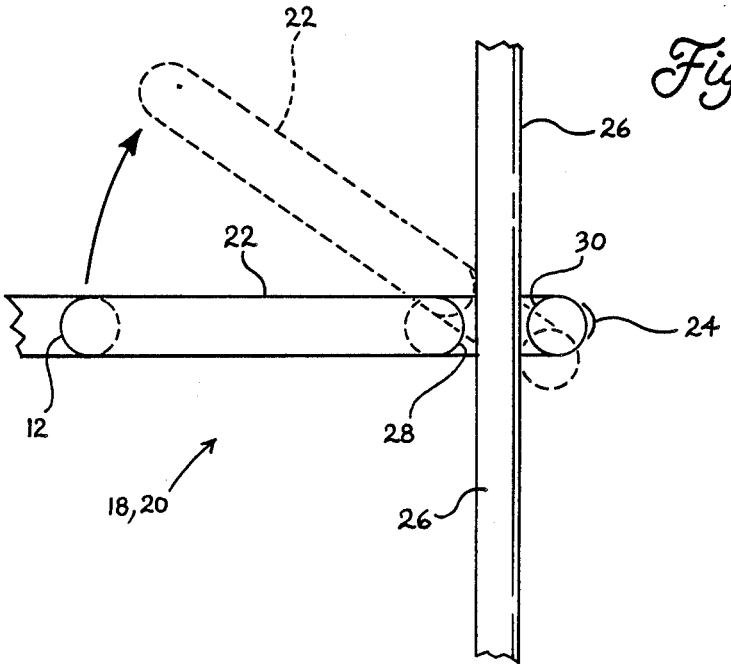
FIG. 3 is a partial bottom view of an unlocking device of the present invention as it engages the door lock linkage of a vehicle door.

Referring now to FIG. 1, the unlocking device 10 comprises an elongated shank 12 having a first end portion 14 and a second end portion 16. The first end portion 14 carries a first linkage engaging means 18 for releasably engaging the door lock linkage within the vehicle door, and, in the preferred embodiment, the second end portion 16 carries a further linkage engaging means 20 which is also designed for releasably engaging the lock linkage within the vehicle door. As is best illustrated in FIG. 2, each of the linkage engaging means 18 and 20 comprises an arm 22 which extends substantially perpendicular to the shank 12 and which has an outboard end defining an inverted U-shaped engaging member 24 for releasably engaging the door lock linkage of a vehicle. More specifically, the U-shaped engaging members 24 are designed to receive the door lock linkage 26 of an automobile lock mechanism. With the linkage 26 thusly positioned in the member 24, the device 10 can be pivoted, as illustrated in FIG. 3, such that the side portions 28 and 30 of the U-shaped member 24 bind against the linkage 26, thereby allowing the linkage to be selectively actuated by manipulation of the device 10 as discussed in detail below.

Of course, both the first linkage engaging means 18 and the further linkage engaging means 20 can be used for engaging and manipulating the linkage of a locking mechanism. It will be noted, however, that in the preferred embodiment the arm 22 of the engaging member 18 defines the length L1 while the arm 22 of the engaging member 20 defines the greater length L2 (See FIG. 1). This difference in lengths of the arms 22 allows the device 10 to be used to open vehicles having various door thicknesses. Accordingly, where a vehicle has a narrow door it may be appropriate to use the engaging means 18 and with thicker doors the engaging means 20 may be more appropriate. It will also be appreciated that the engaging means 18 or 20 which is not utilized to engage the linkage 26 serves as a handle during the unlocking operation, and facilitates the pivoting of the device 10 such that the device securely engages the linkage as described above.

Figure 4:
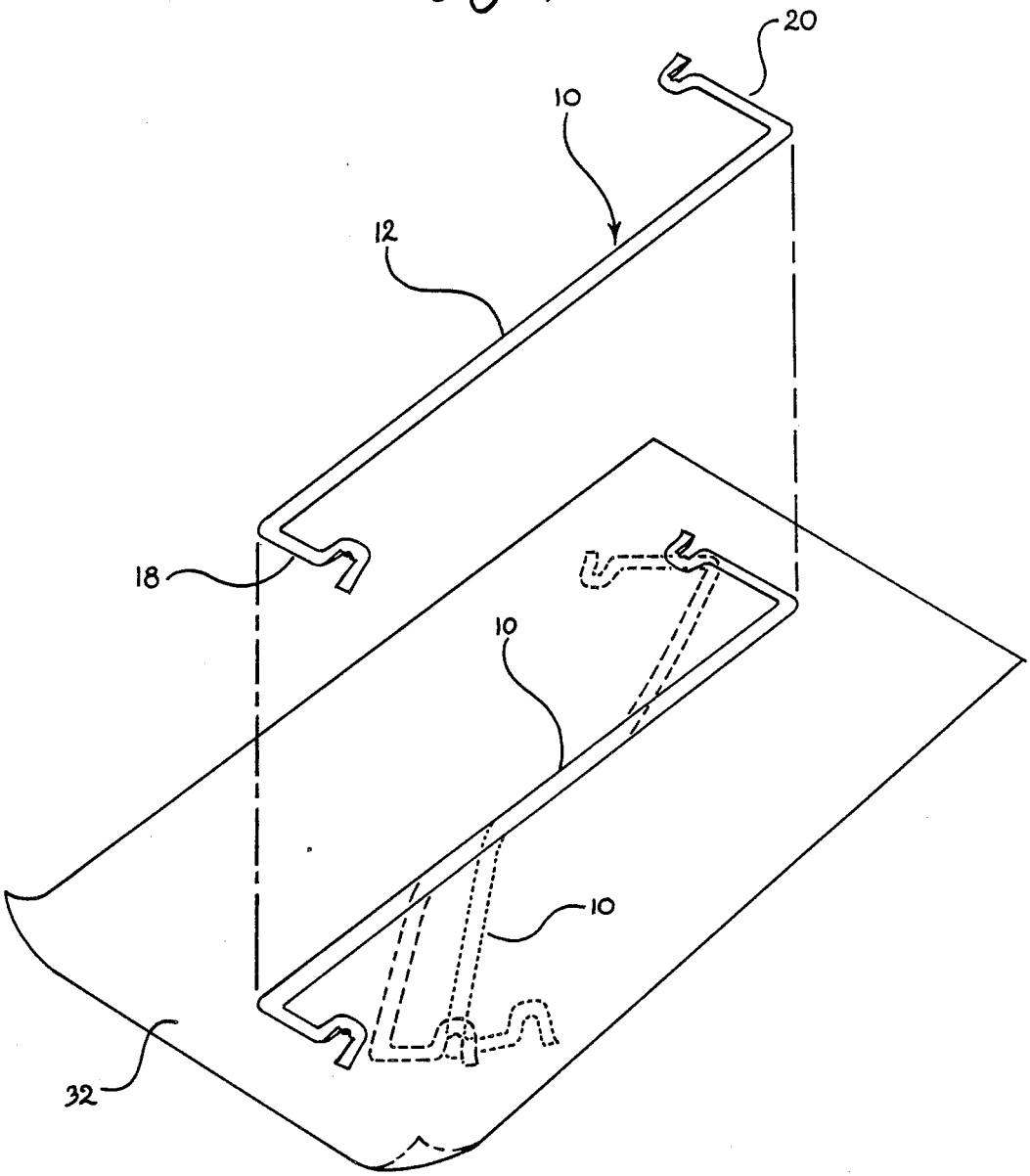
FIG. 4 is a perspective view of an unlocking device of the present invention and the operatively associated bend chart.
Figure 5A:
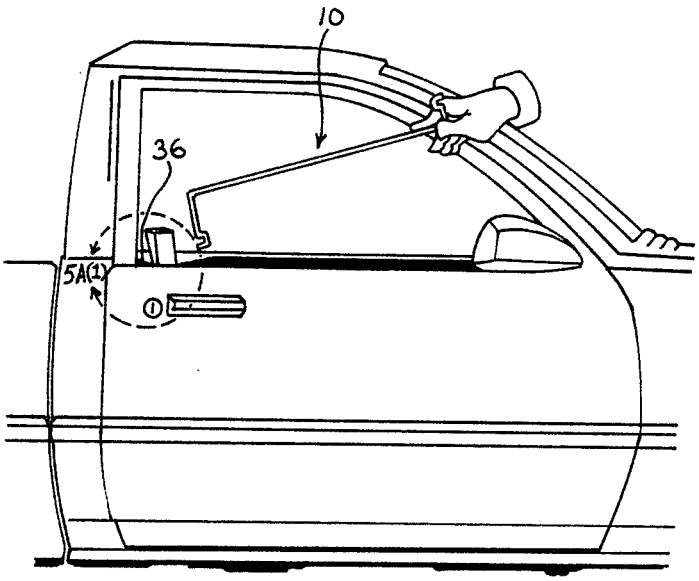
FIGS. 5A through 5D are diagrammatic perspective views of an unlocking device of the present invention being utilized to unlock a vehicle door.
Figure 5B:
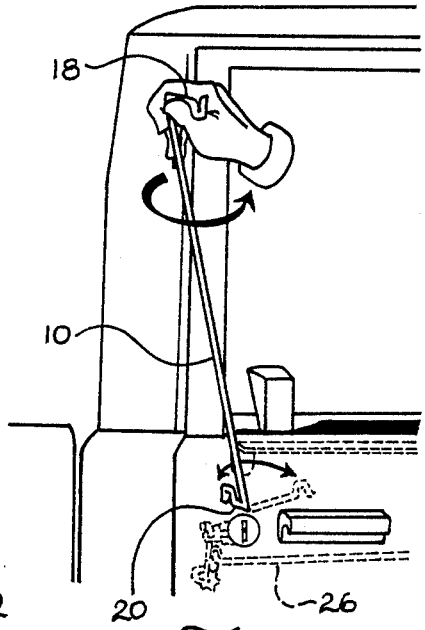
Figure 5C:
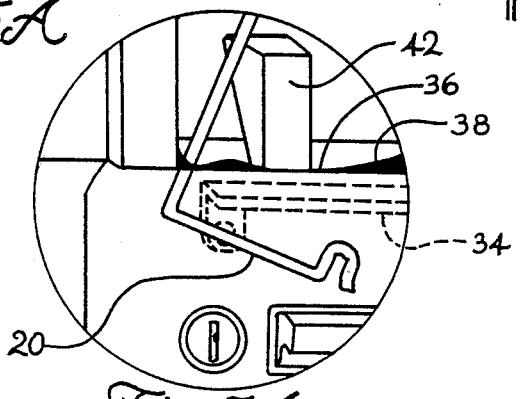
Figure 5C:
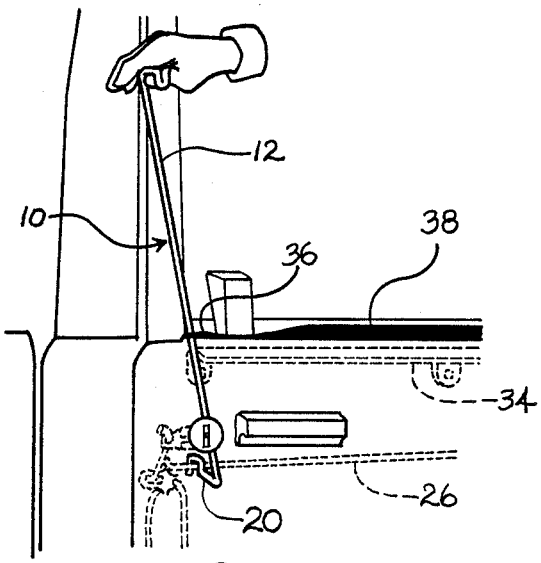
Figure 5D:
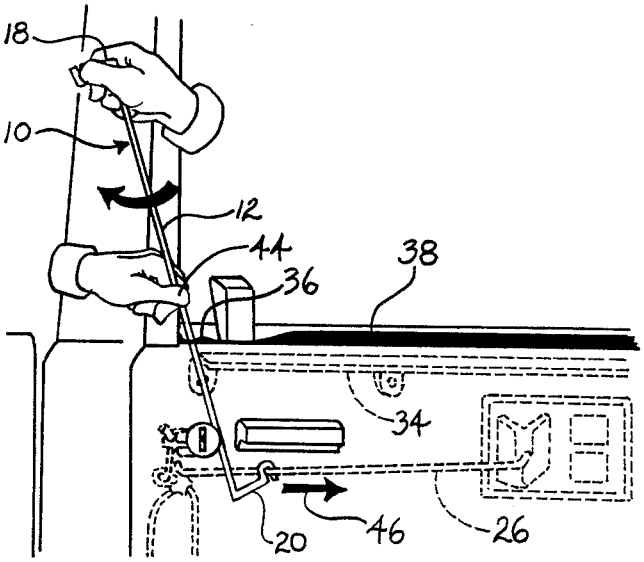

In the preferred embodiment, the unlocking device 10 is integrally formed from a metal rod or wire, but other strong durable materials can be used if desired. It will be noted, however, that in the preferred embodiment, the shank 12 of the device 10 is manually bendable, yet capable of retaining the altered configuration into which it is bent throughout the unlocking process. In this regard, 6 to 8 gauge wire of low carbon steel having high tinsel strength has proven to be one suitable fabricating material. This bendability of the shank 12 facilitates the adaptability of the device 10 to use with vehicles having various door lock linkage configurations and door thicknesses. For example, a specific bend in the shank 12 may be necessary to avoid a specific anti-theft guard, or to bring the linkage engaging means into contact at the most desirable location. Further, whereas the linkage engaging means 18 may be suitable for use with vehicles having narrow doors, without bending the shank 12, and the means 20 may be suitable for use with vehicles having doors of medium thickness, the bendability of the shank 12 allows the device 10, utilizing either the means 18 or 20, to be configured for use with vehicles having very thick doors where access to the linkage through the window slot would not otherwise be possible. Of course, the bendability of the shank 12 allows the small linkage engaging means to be utilized in unlocking doors of various thicknesses. In order to facilitate the unlocking procedure, the device 10 can be provided with a bend chart 32, as illustrated in FIG. 4, which illustrates the most desirable configurations for unlocking various vehicles such that the user can bend the shank 12 to assume the most advantageous configuration. Of course, as illustrated in FIG. 4, it is desirable that the diagram 10′ of the device 10 depicted on the chart 32 be to scale such that the device can be positioned over the chart 32 and bent to assume the altered configuration desired, such altered configurations being outlined in broken lines at 10″ in FIG. 4.

With respect to the operation of the unlocking device 10, FIGS. 5A through 5D illustrate the device 10 being used to unlock a vehicle having a horizontal linkage 26. It will also be noted that the vehicle depicted is provided with an anti-theft window guard 34 designed to frustrate conventional unlocking devices from entering into the interior of the door. As illustrated, the linkage engaging means 20 (or the means 18 where the door to be unlocked is narrow) is inserted into the window slot 36 proximate the rear of the vehicle door so as to avoid the guard 34, and into the interior of the door. It will be appreciated that there is generally weather stripping 38 secured to the door at the mouth of the window slot 36 which forms a seal between the door and window of the vehicle to prevent water from entering into the interior of the door through the slot 36. In the preferred embodiment, the side portion 30 of each of the U-shaped members 24 defines a pointed free-end portion 40 which can easily be slipped between the weather stripping 38 and the window and used to pull the stripping aside such that entry into the interior of the door can be gained. It will also be noted that a wedge 42 (or other object, e.g., a ball point pen), inserted between the window and the weather stripping 38, can be helpful in holding the window away from the edge of the slot 36 to allow better manipulation of the shank 12 as the linkage engaging means is received in the interior of the door. The pointed free-end portions 40 can be particularly useful in pulling aside the weather stripping 38 such that a wedge can be inserted between the stripping 38 and the window.

Once the engaging means 20 has been inserted past the guard 34 and into the interior of the door, the device 10 is rotated counterclockwise (See FIG. 5B) (clockwise rotation may be required for other applications) to align the U-shaped engaging member 24 with the linkage 26 and the device 10 is then lowered such that the engaging member 24 receives the linkage 26. The device 10 is then rotated in a clockwise direction (counterclockwise rotation may be required for other applications) utilizing the engaging means 18 such that the means 20 securely engages the linkage 26, (See FIG. 5D) and using the operators thumb 44, or some structure such as a fulcrum, the device 10 is pivoted so as to move the linkage 26 in the direction indicated by the arrow 46, thus unlocking the door. Of course, it will be recoginzed that the direction of linkage movement required to effect the unlocking of the door may vary with different locking mechanisms.

It will be appreciated that in order to avoid the various anti-theft devices provided on vehicles in recent years, the U-shaped members 24 must be small in size. Therefore, the width of the U-shaped members 24, referenced at W1 of FIG. 2, should equal less than one inch and the length of the members 24, referenced at L3 of FIG. 2, should equal less than one inch. In this regard, in the preferred embodiment, W1 and L3 each equal approximately 0.64 inches, such that the U-shaped members are large enough to properly engage the linkage of a vehicle door, yet small enough to be moved around the various anti-theft devices commonly found on newer vehicles. Further, as illustrated in FIG. 2, in the preferred embodiment the side portions 30 of the U-shaped members 24 are provided with outwardly flared free-end portions 31. It will be appreciated that this flared free-end portion 31 facilitates the engaging of the linkage 26 by providing a surface for contacting the linkage and directing the linkage into the U-shaped member 24. In the preferred emboidment, the width of the flare, referenced at W2 of FIG. 2 is approximately 0.125 inches.

Figure 11A:
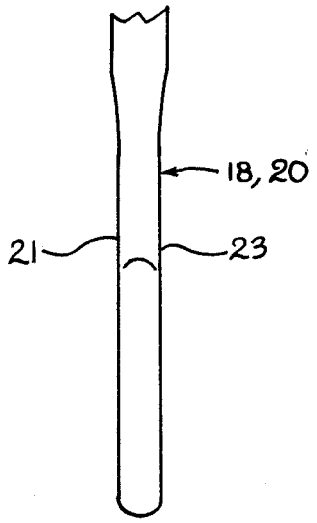
FIG. 11A is a partial front view of an unlocking device of the present invention.
Figure 11B:
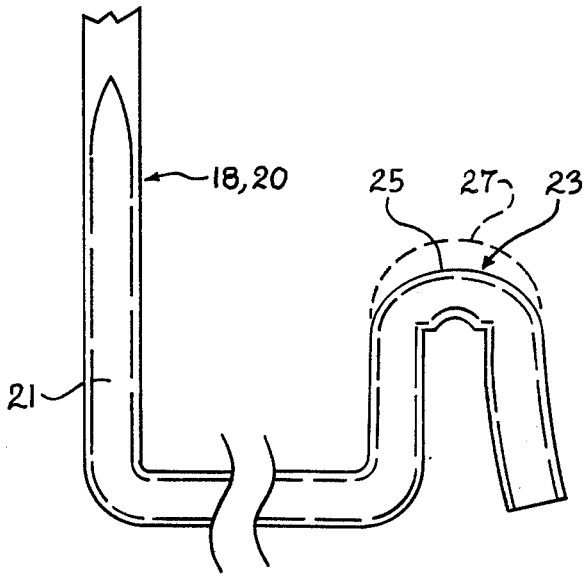
FIG. 11B is a partial side elevation view of an unlocking device of the present invention.

Referring now to FIGS. 11A and 11B, the ability of the device 10 to overcome anti-theft can be further enhanced by narrowing the width of the linkage engaging means 18 and/or 20 as by grinding down the flanks of the engaging means 18 and 20 so as to define the narrowed flank portions 21 and 23. Of course, this narrowing of the means 18 and 20 allows insertion of the means 18 and/or 20 through narrow gaps or openings which are generally available even where anti-theft devices are present.

Figure 6A:
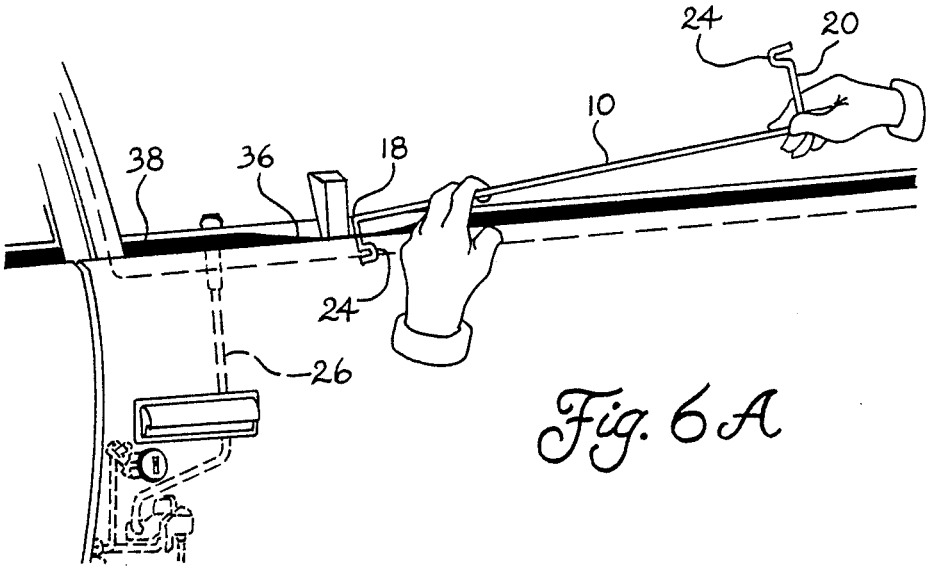
FIGS. 6A through 6C are diagrammatic perspective views of an unlocking device of the present invention being utilized to unlock a vehicle door.
Figure 6B:
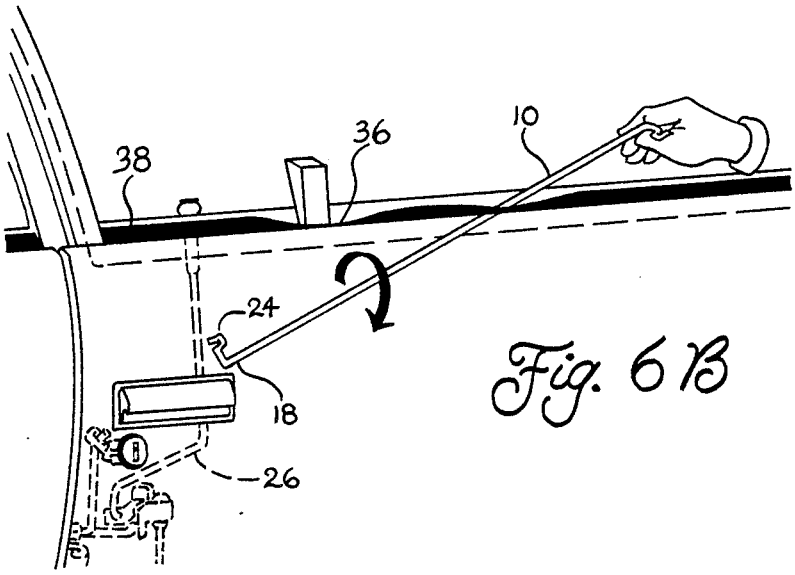
Figure 6C:
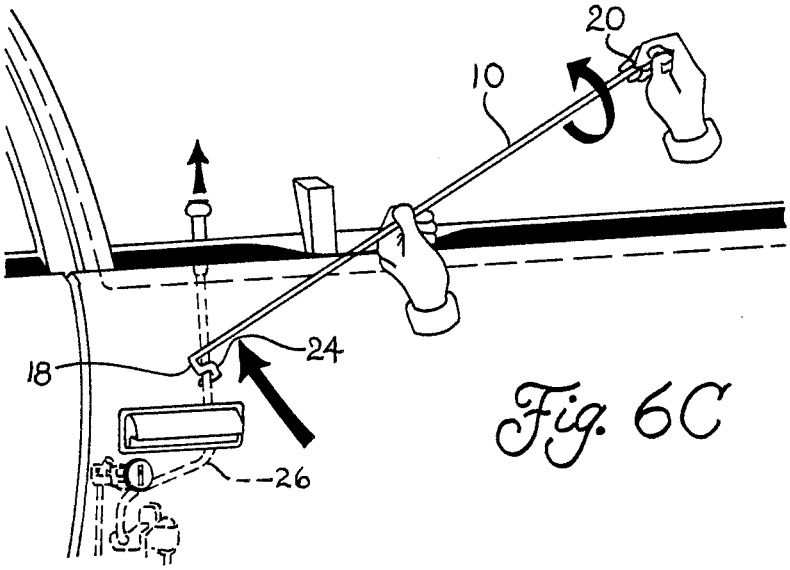

FIGS. 6A through 6C illustrate the unlocking device 10 being used to unlock the doors of a vehicle having a vertical door lock linkage 26. As illustrated in FIG. 6A, the first engaging means 18 is inserted into the window slot 36, past the weather stripping 38, and into the interior of the vehicle door. The device 10 is then rotated to align the U-shaped member 24 with the linkage 26 and the member 24 is then moved into position to receive the linkage 26 (See FIG. 6B). The device 10 is then rotated clockwise (or counterclockwise) such that the member 24 securely engages the linkage 26, and using the operators hand 48 as a fulcrum the device is pivoted such that the engaging means 18 moves upwardly, thereby moving the manual lock button upwardly to its unlocked position.

Figure 7:
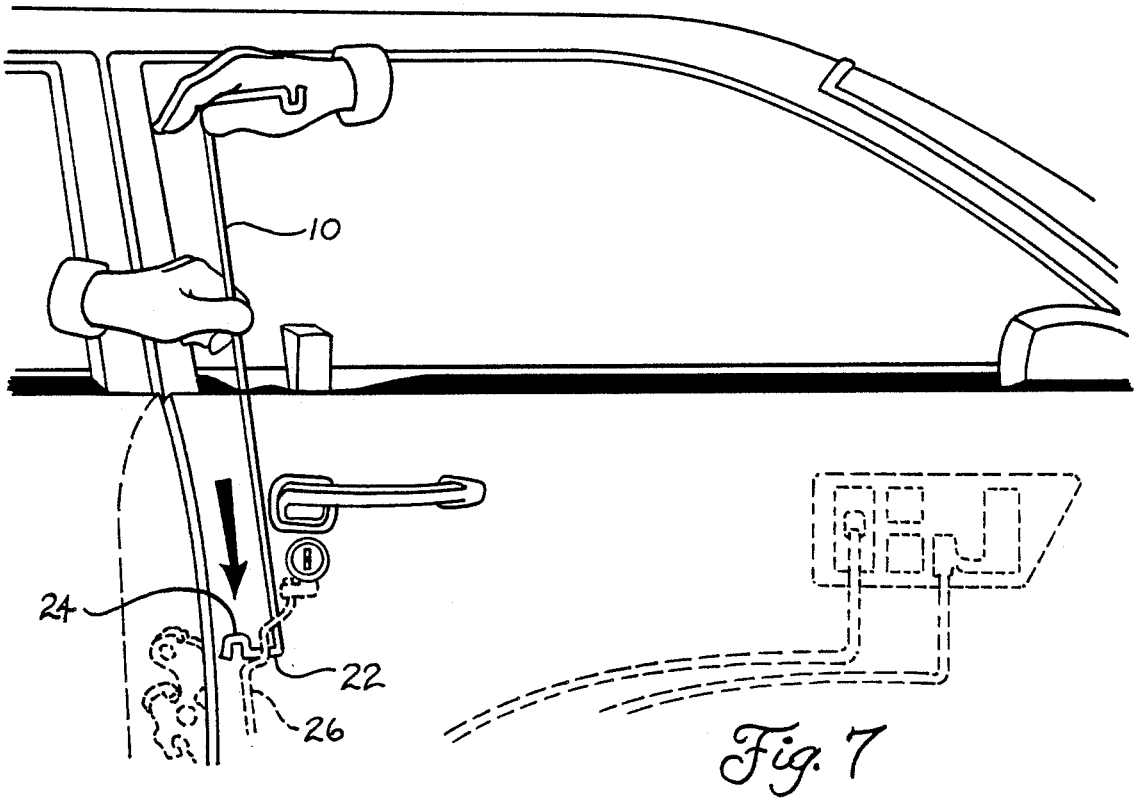
FIG. 7 is a diagrammatic perspective view of an unlocking device of the present invention being utilized to unlock a vehicle door.
Figure 8:
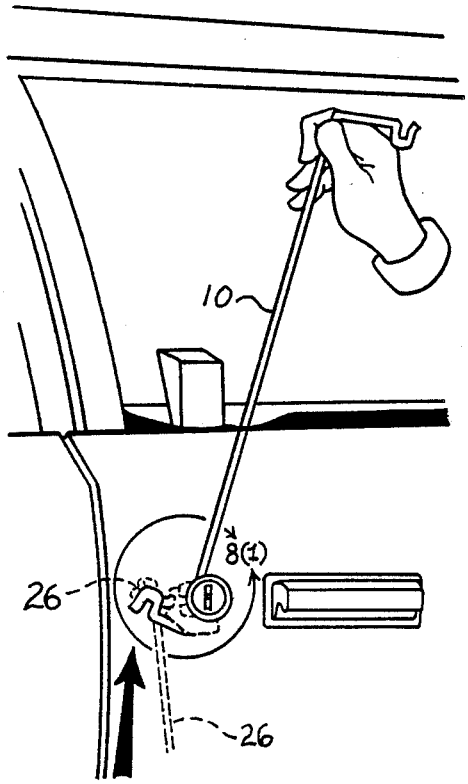
FIG. 8 and 8(1) is a diagrammatic perspective view of an unlocking device of the present invention being utilized to unlock a vehicle door.
Figure 8:
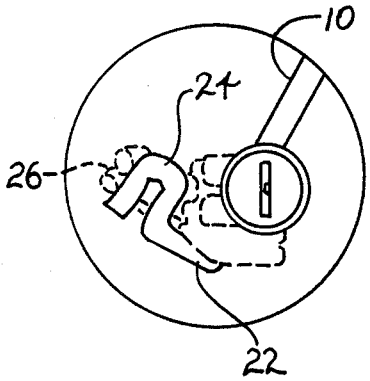

Referring now to FIGS. 7, 8 and 8(1), it will be noted that the arm 22 of either the linkage engaging means 18 or 20 can be utilized to engage the linkage 26 in order to unlock certain vehicle doors. As illustrated in FIG. 7, certain vehicles are unlocked by downward travel of a section of the linkage 26, and the arm 22 can be used to engage and exert downward force on the linkage 26 to unlock the door. And, as illustrated in FIG. 8, certain vehicle doors are unlocked by upward travel of a portion of the linkage 26, and the arm 22 can be hooked under the linkage 26 and used to apply upward force on the linkage 26 thereby unlocking such doors. It will also be noted that in the preferred embodiment, as illustrated in FIG. 11B, the U-shaped member defines a flattened upper surface 25 rather than the arcuate upper surface, depicted at 27, which is common among conventional unlocking devices. It will be understood that this flattened upper surface 25 provides yet a further engaging surface for actuating the linkage 26, this feature being particularly useful where the unlocking involves the lifting of the linkage 26.

In the preferred embodiment of the unlocking device 10, the U-shaped engaging member 24 of each of the linkage engaging means 18 and 20 defines an outer surface portion 50 provided with a plurality of teeth 52, as is best illustrated in FIG. 2. The teeth 52 facilitate the engaging of the door lock linkage of certain vehicles, thereby making the device 10 more versatile. For example, as illustrated in FIGS. 9A through 9D(1), the linkages of certain vehicles include manual lock switches protected by a shield 54. As is best illustrated in FIG. 9D and 9D(1), the teeth 52 of the outer surface portion 50 can be used to engage the shield 54. When inward and upward pressure is exerted on the shield 54, it has been found that the shield 54 bends inwardly to engage and move the manual switch upwardly, thereby unlocking the door. Of course, the teeth 52 dig into the shield 54 and obviate slippage during the unlocking process. It will be noted that in FIGS. 9A through 9D(1) (and also in FIGS. 10A through 10D(1) the shank 12 is preselectively bent, as discussed above, to provide the most advantageous configuration for engaging the linkage 26.

Further, in the preferred embodiment, indicia 56, such as the illustrated lines and numerals of FIGS. 1, 9B and 9B(1) and 10B and 10B(1), are provided on the shank 12 of the unlocking device 10 to mark the desired depth of insertion of the device 10 into the interior of the door for engaging the linkage of various vehicles. For example, in order to actuate the linkage 26 of the vehicle depicted in FIG. 10B and 10B(1) it is desirable to insert the device 10 into the door to the indicia 56 marked by the numeral "3". This places the engaging means 20 at a level where it can be pivoted beneath the guard 58 to engage the linkage 26. Without such indicia, a great deal of time and effort would be expended searching for the appropriate depth of insertion. Thus, it will be appreciated that providing such indicia greatly simplifies the locating of the linkage such that it can be engaged by the linkage engaging means 18 or 20.

In light of the above, it will be appreciated that the present invention provides an unlocking device for unlocking vehicle doors having great advantages over the prior art. By providing the device 10 with oppositely disposed linkage engaging means 18 and 20 having arms 22 of different lengths allows the device to be used with vehicles having different door widths, and the bendability of the shank 12 lends further versatility. The pointed free-end portion 40 of the U-shaped member 24 allows for easy insertion of the device 10 past the weather stripping and into the vehicle door, and the indicia 56 provides the desired depth of insertion. Thus, the device 10 is capable of quickly and easily unlocking a wide variety of vehicle doors. It should also be noted that the device 10 can be finished, or coated, with a baked vinyl, or other suitably flexible material, to prevent rusting of the device 10, and to enhance the grip of the device 10 upon the linkage 26.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An unlocking device for unlocking a vehicle door without a key, said vehicle door including a door lock linkage, the auctuation of which unlocks said vehicle door, said unlocking device comprising:

an elongated shank having a first end portion and a second end portion, said shank being provided with indicia means for marking the desired depth of insertion of said unlocking device into said vehicle door; and a first linkage engaging means at said first end portion of said shank for selectively engaging and actuating said door lock linkage, said first engaging means including an arm defineing a first length, said arm having an outboard end provided with a U-shaped engaging member for releasably engaging said linkage.

2. The unlocking device of claim 1 wherein said device further comprises a further linkage engaging means at said second end portion of said shank for engaging and actuating said door lock linkage, said further linkage engaging means including an arm defining a second length, said second length being greater than said first length, said arm having an outboard end provided with a U-shaped engaging member for releasably engaging said lock linkage.

3. The unlocking device of claim 2 wherein said U-shaped members of said first and further linkage engaging means comprise a first side portion attached to said arm and a second side portion defining a pointed free-end portion.

4. The unlocking device of claim 1 wherein said U-shaped member defines an outer surface portion provided with a plurality of teeth for selectively engaging said door lock linkage.

5. The unlocking device of claim 1 wherein said U-shaped member defines an outer surface portion provided with a plurality of teeth for selectively engaging said door lock linkage.

6. An unlocking device for unlocking a vehicle door without a key, said vehicle door including a door lock linkage, the actuation of which unlocks said vehicle door, said unlocking device comprising:

an elongated shank having a first end portion and a second end portion, said shank being bendable such that said unlocking device can be selectively reconfigured to facilitate the unlocking of a variety of said vehicle doors, said shank being provided with indicia means for marking the desired depth of insertion of said unlocking device into said vehicle door;

a first linkage engaging means at said first end portion of said shank for selectively engaging and actuating said door lock linkage, said first engaging means including an arm defining a first length, said arm having an outboard end provided with a U-shaped engaging member for releasably engaging said linkage, said U-shaped member including a first side portion attached to said arm and a second side portion defining a pointed free-end portion, said U-shaped member further defining an outer surface portion provided with a plurality of teeth for selectively engaging said door lock linkage; and a further linkage engaging means at said second end portion of said shank for engaging and actuating said door lock linkage, said further linkage engaging means including a further arm defining a second length, said second length being greater than said first length, said further arm having a outboard end provided with a further U-shaped engaging member for releasably engaging said door lock linkage, said further U-shaped member including a first side portion attached to said further arm and a second side portion defining a pointed free-end portion, said further U-shaped member further defining a outer surface provided with a plurality of teeth for selectively engaging said door lock linkage.

7. The unlocking device of claim 6 wherein said free-end portion of said second side portion of each said U-shaped member is outwardly flared to facilitate the engaging of said door lock linkage.

8. The unlocking device of claim 6 wherein said first and further linkage engaging means define first and further narrowed flank portions.

9. An unlocking device for unlocking a vehicle door without a key, said vehicle door including a door lock linkage, the actuation of which unlocks said vehicle door, said unlocking device comprising:

an elongated shank having a first end portion and a second end portion; and a first linkage engaging means at said first end portion of said shank for selectively engaging and actuating said door lock linkage, said first engaging means including an arm defining a first length, said arm having an outboard end provided with a U-shaped engaging member for releasably engaging said linkage, said U-shaped member including a first side portion attached to said arm and a second side portion defining a pointed free-end portion, and including a further portion connecting and extending between said first side portion and said second side portion.

10. The unlocking device of claim 9 wherein said further portion of said U-shaped member is provided with a flattened outer surface for providing a further engaging surface for engaging said linkage.

11. An unlocking device for unlocking a vehicle door without a key, said vehicle door including a door lock linkage, the actuation of which unlocks said vehicle door, said unlocking device comprising:

an elongated shank having a first end portion and a second end portion, said shank being bendable such that said unlocking device can be selectively reconfigured to facilitate the unlocking of a variety of said vehicle doors;

a first linkage engaging means at said first end portion of said shank for selectively engaging and actuating said door lock linkage, said first engaging means including an arm defining a first length, said arm having an outboard end provided with a U-shaped engaging member for releasably engaging said linkage; and a bend chart illustrating at least one preferred angular configuration into which said shank can be bent to facilitate the engaging of said door lock linkage, whereby said shank is positioned to overlay said bend chart and bent to correspond to said preferred angular configuration.

* * * * *